United States Patent [19]

Hock et al.

[11] 3,997,743

[45] Dec. 14, 1976

[54] PNEUMATICALLY ACTUATED HIGH POWER RF SWITCH

[75] Inventors: Frederick Richard Hock, Columbia; William Dall Hopkins, Woodbine, both of Md.

[73] Assignee: International Telephone and Telegraph Corporation, Nutley, N.J.

[22] Filed: May 1, 1975

[21] Appl. No.: 573,711

[52] U.S. Cl. ..... 200/81 R; 200/81.4; 200/81.5; 200/279

[51] Int. Cl.[2] ..... H01H 35/38

[58] Field of Search ..... 200/16 A, 18, 81.4, 200/81.5, 81 R, 82 R, 82 B, 243, 275, 279

[56] References Cited

UNITED STATES PATENTS

| | | | |
|---|---|---|---|
| 2,825,781 | 3/1958 | Mitchell | 200/81.5 |
| 3,230,323 | 1/1966 | Concannon | 200/81 R |
| 3,649,789 | 3/1972 | Stoll | 200/82 R |
| 3,683,134 | 8/1972 | Beer | 200/275 |

*Primary Examiner*—Gerald P. Tolin
*Attorney, Agent, or Firm*—John T. O'Halloran; Alfred C. Hill

[57] ABSTRACT

The switch includes a mounting plate supporting two high voltage RF contacts in spaced relation with each other and with the mounting plate. A shorting bar is provided between the mounting plate and the two contacts in a switching relation with the two contacts. The shorting bar is actuated by a first pneumatic actuating arrangement supported by the mounting plate to make and break a connection between the shorting bar and both of the contacts. A grounding arrangement actuated by a second pneumatic actuating arrangement grounds one of the two contacts when no connection exists between the shorting bar and both of the contacts and ungrounds the one of the two contacts when a connection exists between the shorting bar and both of the contacts.

15 Claims, 2 Drawing Figures

PNEUMATICALLY ACTUATED HIGH POWER RF SWITCH

BACKGROUND OF THE INVENTION

This invention relates to switches and more particularly to a high power RF (radio frequency) switch.

Prior art switches intended for use with high frequency at power levels of 10 KW (kilowatts) and greater have been of three general types. The three general types of switches are coaxial, vacuum and motor driven plunger or knife switches.

The coaxial category of switches are intended for use with coaxial transmission lines. Due to the nature of their intended application, such switches involve distributed capacitance and inductance values consistent with the impedance and power ratings of the transmission lines with which they must conform. These values of capacitance and inductance are not suited to applications involving RF impedance levels significantly higher or lower than that of the characteristic impedance of the lines for which the switch was designed. This impedance is generally 50 ohms. Additionally, such switches are generally limited in RF voltage and current capabilities consistent with the transmission line they were intended to interface with. The application of such switches is, in general, limited to use with the specific transmission lines for which they were designed.

The category of vacuum switches includes those which have contacts mounted within an evacuated envelope. They may be actuated by either an electromagnetic solenoid, pneumatically, or with a cam mechanism. The contacts take the form of two conducting rods, one fixed and one movable. The movable rod is displaced along its axis to bring it into contact with the fixed rod. The vacuum seal is maintained by mounting the movable rod to a bellows which moves with the rod. The use of such bellows limits the maximum practicable travel of the movable contact rod. In order to limit the amount of flexure, the bellows must be limited to travel only a small percentage of their overall length. As a result, the total electrical path through the switch must be long with respect to the gap achieved when the switch is open. This is incompatible with low intercontact capacitance and low switch inductance.

The third category of switches for high power RF application are motor operated plunger or knife switches. These switches are either conductive rods which are driven through contact rings or blades with the rods being driven between the contacts. In either case, the large travel required for high voltage applications results in operating times of several seconds or in complex mechanical systems with their inherent poor reliability. As with the coaxial and vacuum types, the plunger or knife switches generally result in relatively large values of stray capacitance and inductance.

In applications where the values of stray capacitance and inductance are critical limits to the practicability of a design, the above mentioned switches are unacceptable. In the development of high power RF switches, five parameters are of importance. These parameters are: (1) capacitance between open switch contacts, (2) capacitance from the contacts to ground, (3) inductance of the active path through the switch, (4) speed of actuation and (5) reliability. None of the types of switches mentioned hereinabove meet these five requirements.

SUMMARY OF THE INVENTION

An object of the present invention is to provide a high power RF switch which will meet the above-mentioned five requirements.

A feature of the present invention is the provision of a high power RF switch comprising: a mounting plate disposed in a first plane; a first high voltage RF contact supported from one side of the mounting plate and disposed in a second plane spaced from and parallel to the first plane; a second high voltage RF contact supported from the one side of the mounting plate and disposed in the second plane spaced from the first contact; a shorting bar disposed in switching relationship with both the first and second contacts, the shorting bar being disposed between the mounting plate and the first and second contacts; and a first pneumatic actuating means supported from the mounting plate and connected to the shorting bar to make and break a connection between the shorting bar and both of the first and second contacts.

Another feature of the present invention is the provision of, in conjunction with the above mentioned switch of this invention, a grounding arrangement supported from one side of the mounting plate and in operative association with the second contact; and a second pneumatic actuating means supported from the mounting plate and connected to the grounding arrangement, the second contact being grounded by the grounding arrangement when no connection exists between the shorting bar and both of the first and second contacts and the second contact being ungrounded by the grounding arrangement when a connection exists between the shorting bar and both of the first and second contacts.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figures 1, 2:
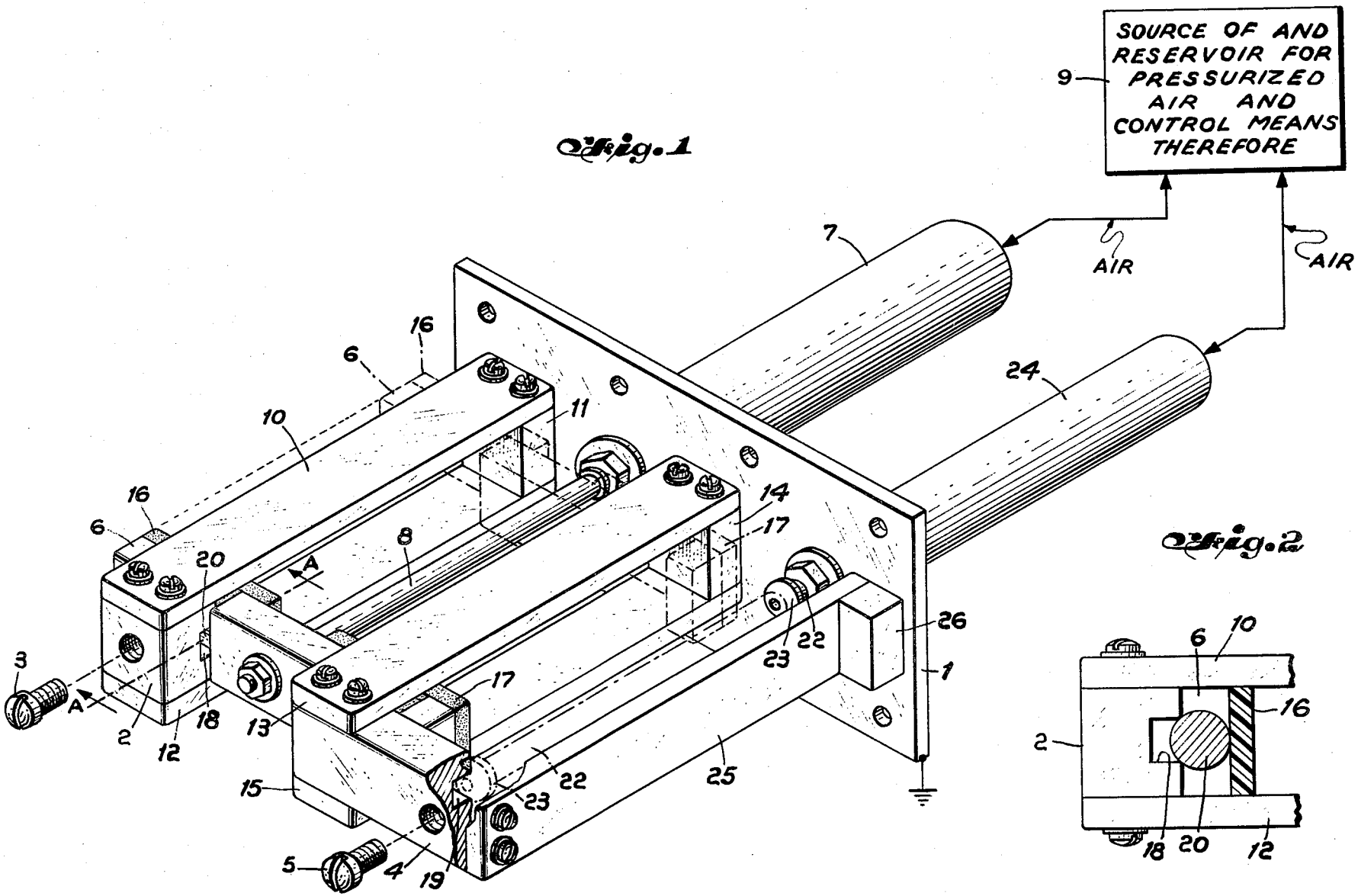
FIG. 1 is an isometric view of the high power RF switch in accordance with the principles of the present invention.
FIG. 2 is a cross-sectional view taken along line A—A of FIG. 1.

Referring to FIGS. 1 and 2, the switch of the present invention includes a mounting plate 1 which provides a ground for the switch, a first high voltage RF contact 2 supported from one side of plate 1 having connection means in the form of bolt 3 to connect contact 2 to a high voltage RF input, a second high voltage RF contact 4 supported from plate 1 which provides by means of bolt 5 a connection to a high voltage RF circuit, a shorting bar 6 disposed in a switching relationship with contacts 2 and 4 with bar 6 being disposed between plate 1 and contacts 2 and 4 and a first pneumatic actuating means including primary pneumatic air cylinder 7, insulated shaft 8 and block 9 which includes a source of and a reservoir for pressurized air and control means associated therewith. The actuation means is supported from plate 1 and connected to the center of shorting bar 6 to make and break a connection between shorting bar 6 and contacts 2 and 4.

Contact 2 is connected between a first insulated support 10 connected to plate 1 by mounting member 11 and a second insulated support 12 also connected to member 11 with member 11 being connected to plate 1.

Contact 4 is supported between a third insulated support 13 connected to mounting plate 1 by mounting block 14 which is mounted to plate 1 and a fourth insulated support 15 also mounted to mounting member 14.

When shorting bar 6 is actuated, it slides between supports 10, 12 and 13, 15 with the aid of insulated guides 16 and 17.

Shorting bar 6 is connected to insulated shaft 8 at one end thereof and the other end of shaft 8 is connected to a piston (not shown) within cylinder 7. The piston within cylinder 7 is spring biased so that without air pressure applied to the piston shaft 8 will be pulled into cylinder 7, thus moving shorting bar 6 away from contacts 2 and 4 into the normally open position of the switch shown by the dot-dash lines. The solid line illustration of shorting bar 6 illustrates the normally closed position of the switch.

Contacts 2 and 4 are both formed to contain a channel therein such as channels 18 and 19. The shorting bar is circular in cross-section as shown at 20 in the region of channels 18 and 19.

In addition to the switch just described which constitutes the major portion of the switch of the present invention, there is provided a secondary switching arrangement which grounds contact 4 when shorting bar 6 is moved to its normally open position and unground contact 4 when shorting bar 6 is moved to its normally closed position. This grounding arrangement includes a conductive shaft 22 having on one end thereof a grounding knob 23. The other end of shaft 22 is connected to a piston (not shown) contained in a secondary pneumatic air cylinder 24 with the piston being spring biased to move shaft 22 into cylinder 24 when there is no air pressure applied to the piston within cylinder 24. The position of shaft 22 and knob 23 illustrated in solid lines is the normally open position of this portion of the switch, while the dotted representation of shaft 22 and knob 23 is the normally closed position of this portion of the switch.

As previously mentioned, block 9 includes a source of pressurized air and a reservoir for pressurized air together with control means associated with the source, the reservoir and also cylinders 7 and 24. The control means can be a valve arrangement for switch actuation by applying pressurized air from the source to cylinder 7 to place the shorting bar in its normally closed position and at the same time remove air from cylinder 24 to the reservoir so that shaft 22 and knob 23 will assume its normally open position. With the switch is deactivated, the control valve arrangement will apply pressurized air to cylinder 24 to move shaft 22 and knob 23 to its normally closed position and simultaneously remove air from cylinder 7 to the reservoir so that shorting bar 6 can assume its normally open position.

The design of the switch of the present invention achieves reliable contact by the use of a pneumatic actuator which applies large contact pressure when the switch is closed. The design of the fixed contacts 2 and 4 results in small cross-sectional areas of their adjacent parallel faces and, therefore, low intercontact capacitance. The long travel of the movable shorting bar 6 permits contacts 2 and 4 to be mounted away from the ground plane, which is the mounting plate 1, resulting in relatively low capacitance between contacts 2 and 4 and ground.

The inclusion of a second traveling contact, shaft 22 and knob 23, which connects contact 4 to ground results in increased isolation across the open switch. Actuation times of less than 300 milliseconds are obtainable with available pneumatic actuators.

The switch illustrated was designed for handling approximately 100 KW, however, the design of the switch permits scaling up or down for application to RF power levels other than the 100 KW.

The shorting bar 6 is made of copper and is machined to a cylindrical shape 20 in the area where shorting bar 6 mates with contacts 2 and 4. The primary pneumatic air cylinder 7 operates within a range of 60 to 100 PSI (pounds per square inch) of air pressure which with a pneumatic piston area of 1.2 square inches results in 96 pounds of force between each of the contacts 2 and 4 and shorting bar 6. The purpose of the secondary switch provided by shaft 22 and knob 23 is to provide a conductive path from contact 4 to ground when shorting bar 6 of the primary switch is in the open position.

Grounding knob 23 is copper and machined to spherical shape. When the secondary pneumatic air cylinder 24 is fully actuated, grounding knob 23 will seat securely in channel 19 of contact 4. This assures that the associated RF circuitry connected to contact 4 by bolt 5 is grounded. When the primary part of the switch of this invention is in the closed position, the secondary part of the switch of this invention is in its open position.

Contacts 2 and 4 are made of copper and are shaped like an extruded channel to provide channels 18 and 19. The extruded channel configuration allows the cylindrical portion 20 of shorting bar 6 to seat itself between the edges of the channel with a combined total contact pressure of 130 PSI based on 96 pounds of force.

As previously mentioned, contacts 2 and 4 are held in position by four insulated contact supports 10, 12 and 13, 15, respectively. In addition thereto, contact 4, due to the secondary portion of the switch of the present invention, is connected to plate 1 by insulated contact support 25 which is secured to plate 1 by grounding member 26 which is mounted to plate 1.

Contacts 2 and 4 are so spaced that they have sufficient voltage insulation to withstand 1 to 20 kilovolts peak at 30 MHz (megahertz) from contact 2 to ground and also from contact 2 to contact 4 when contacts 2 and 4 are in the open position while at the same time not exceeding 2 picofarads across the open contacts 2 and 4.

The switch of the present invention described hereinabove has application in state-of-the-art high power LF (low frequency) RF systems where stray capacitance and inductance are critical and no sacrifice in actuation speed or reliability is satisfactory.

Such applications include:

1. Band switching frequency high power transmitter networks;
2. Selecting filter networks in high power HF (high frequency) systems;
3. Antenna switching in HF RF radio transmitter systems; and
4. High power HF matrix switches.

While we have described above the principles of our invention in connection with specific apparatus it is to be clearly understood that this description is made only by way of example and not as a limitation to the scope of our invention as set forth in the objects thereof and in the accompanying claims.

We claim:

1. A high power radio frequency (RF) switch comprising:

a mounting plate disposed in a first plane;

a first high voltage RF contact supported from one side of said mounting plate and disposed in a second plane spaced from and parallel to said first plane;

a second high voltage RF contact supported from said one side of said mounting plate and disposed in said second plane spaced from said first contact;

a shorting bar disposed in switching relationship with both said first and second contacts, said shorting bar being disposed between said mounting plate and said first and second contacts; and a first pneumatic actuating means supported from said mounting plate and connected to said shorting bar to make and break a connection between said shorting bar and both of said first and second contacts;

said first contact being supported between a first insulated support connected to said mounting plate in a third plane perpendicular to said first and second planes and a second insulated support connected to said mounting plate in a fourth plane parallel to and spaced from said third plane;

said second contact being supported between a third insulated support connected to said mounting plate in said third plane spaced from said first insulated support and a fourth insulated support connected to said mounting plate in said fourth plane spaced from said second insulated support;

said shorting bar sliding between said first and second insulated supports and between said third and fourth insulated supports upon actuation of said shorting bar by said first actuating means;

each of said first and second contacts having a channel formed in a surface thereof facing said mounting plate; and said shorting bar including a cylindrical portion adjacent each of said channels, said cylindrical portion contacting the edges of an associated one of said channels when a connection is made between said shorting bar and both of said first and second contacts.

2. A switch according to claim 1, further including a first insulated guide connected to said shorting bar parallel to and in contact with one of said cylindrical portions and extending between said first and second insulated supports; and a second insulated guide connected to said shorting parallel to and in contact with the other of said cylindrical portions and extending between said third and fourth insulated supports.

3. A switch according to claim 2, wherein said first actuating means includes a pneumatic cylinder mounted on the other side of said mounting plate, and an insulated shaft having one end in an operative relation with said pneumatic cylinder and the other end connected to said shorting bar between said first and second insulating supports and said third and fourth insulating supports.

4. A high power radio frequency (RF) switch comprising:

a mounting plate disposed in a first plane;

a first high voltage RF contact supported from one side of said mounting plate and disposed in a second plane spaced from and parallel to said first plane;

a second high voltage RF contact supported from said one side of said mounting plate and disposed in said second plane spaced from said first contact;

a shorting bar disposed in switching relationship with both said first and second contacts, said shorting bar being disposed between said mounting plate and said first and second contacts; and a first pneumatic actuating means supported from said mounting plate and connected to said shorting bar to make and break a connection between said shorting bar and both of said first and second contacts;

each of said first and second contacts having a channel formed in a surface thereof facing said mounting plate, and said shorting bar includes a cylindrical portion adjacent each of said channels, said cylindrical portion contacting the edges of an associated one of said channels when a connection is made between said shorting bar and both of said first and second contacts.

5. A high power radio frequency (RF) switch comprising:

a mounting plate disposed in a first plane;

a first high voltage RF contact supported from one side of said mounting plate and disposed in a second plane spaced from and parallel to said first plane;

a second high voltage RF contact supported from said one side of said mounting plate and disposed in said second plane spaced from said first contact;

a shorting bar disposed in switching relationship with both said first and second contacts, said shorting bar being disposed between said mounting plate and said first and second contacts;

a first pneumatic actuating means supported from said mounting plate and connected to said shorting bar to make and break a connection between said shorting bar and both of said first and second contacts;

a first insulated guide connected to a surface of said shorting bar facing said mounting plate adjacent said first contact; and a second insulated guide connected to a surface of said shorting bar facing said mounting plate adjacent said second contact.

6. A high power radio frequency (RF) switch comprising:

a mounting plate disposed in a first plane;

a first high voltage RF contact supported from one side of said mounting plate and disposed in a second plane spaced from and parallel to said first plane;

a second high voltage RF contact supported from said one side of said mounting plate and disposed in said second plane spaced from said first contact;

a shorting bar disposed in switching relationship with both said first and second contacts, said shorting bar being disposed between said mounting plate and said first and second contacts;

a first pneumatic actuating means supported from said mounting plate and connected to said shorting bar to make and break a connection between said shorting bar and both of said first and second contacts;

a grounding arrangement supported from said one side of said mounting plate and in an operative association with said second contact; and a second pneumatic actuating means supported from said mounting plate and connected to said grounding arrangement, said second contact being grounded by said grounding arrangement when no connection exists between said shorting bar and both of said first and second contacts and said second contact being ungrounded by said grounding arrangement when a connection exists between said shorting bar and both of said first and second contacts.

7. A switch according to claim 6, wherein said grounding arrangement includes a conductive shaft supported from said one side of said mounting plate, and a grounding knob connected to one end of said conductive shaft adjacent said second contact and in operative relation therewith; and said second actuating means includes a first pneumatic cylinder mounted on the other side of said mounting plate in an operative relation with the other end of said conductive shaft.

8. A switch according to claim 7, wherein said first contact is supported between a first insulated support connected to said mounting plate in a third plane perpendicular to said first and second planes and a second insulated support connected to said mounting plate in a fourth plane parallel to and spaced from said third plane, and said second contact is supported between a third insulated support connected to said mounting plate in said third plane spaced from said first insulated support, a fourth insulated support connected to said mounting plate in said fourth plane spaced from said second insulated support and a fifth insulated support connected to said mounting plate in a fifth plane perpendicular to said first, second, third and fourth planes parallel to said conductive shaft.

9. A switch according to claim 8, wherein said shorting bar slides between said first and second insulated supports and between said third and fourth insulated supports upon actuation of said shorting bar by said first actuating means.

10. A switch according to claim 9, wherein each of said first and second contacts has a channel formed in a surface thereof facing said mounting plate, and said shorting bar includes a cylindrical portion adjacent each of said channels, said cylindrical portion contacting the edges of an associated one of said channels when a connection is made between said shorting bar and both of said first and second contacts.

11. A switch according to claim 10, wherein a first insulated guide connected to said shorting bar parallel to and in contact with one of said cylindrical portions and extending between said first and second insulated supports; and a second insulated guide connected to said shorting parallel to and in contact with the other of said cylindrical portions and extending between said third and fourth insulated supports.

12. A switch according to claim 11, wherein said first actuating means includes a second pneumatic cylinder mounted on the other side of said mounting plate, and an insulated shaft having one end in an operative relation with said second pneumatic cylinder and the other end connected to said shorting bar between said first and second insulating supports and said third and fourth insulating supports.

13. A switch according to claim 6, wherein each of said first and second contacts has a channel formed in a surface thereof facing said mounting plate, and said shorting bar includes a cylindrical portion adjacent each of said channels, said cylindrical portion contacting the edges of an associated one of said channels when a connection is made between said shorting bar and both of said first and second contacts.

14. A switch according to claim 6, further including a first insulated guide connected to a surface of said shorting bar facing said mounting plate adjacent said first contact; and a second insulated guide connected to a surface of said shorting bar facing said mounting plate adjacent said second contact.

15. A switch according to claim 6, wherein said first actuating means includes a pneumatic cylinder mounted on the other side of said mounting plate, and an insulated shaft having one end in an operative relation with said pneumatic cylinder and the other end connected to said shorting bar.

* * * * *